United States Patent [19]

Hedtke et al.

[11] 4,231,450

[45] Nov. 4, 1980

[54] OVERLOAD WARNING SYSTEM

[75] Inventors: Robert G. Hedtke, Excelsior; Harley A. Harrom, Watertown; Wilfred H. Kelley, Jr., Maple Plain; Sherman B. Frederick, New Hope, all of Minn.

[73] Assignee: White Farm Equipment Company, Oak Brook, Ill.

[21] Appl. No.: 953,424

[22] Filed: Oct. 23, 1978

[51] Int. Cl.[3] ..... B66B 9/20

[52] U.S. Cl. ..... 187/9 R; 180/282; 414/631

[58] Field of Search ..... 187/9 R, 9 E; 180/82 R; 414/719, 631, 632, 634, 637, 638

[56] References Cited

U.S. PATENT DOCUMENTS

| | | | |
|---|---|---|---|
| 2,704,132 | 3/1955 | Marco | 180/82 |
| 2,751,994 | 6/1956 | Remde | 180/82 |
| 3,630,317 | 12/1971 | Jacobsson | 187/9 R |

*Primary Examiner*—Robert J. Spar
*Assistant Examiner*—Kenneth Noland
*Attorney, Agent, or Firm*—Watts, Hoffmann, Fisher & Heinke Co.

[57] ABSTRACT

An overload warning system for an industrial lift truck including a fluid supported rear suspension, pressure responsive switches communicating with the fluid suspension, and a mast height sensor. One pressure switch is actuatable by a first preset pressure in the fluid suspension to signal the presence of a lift overload with the lift mast retracted. The other pressure switch is actuable by a second preset pressure in the fluid suspension and coacts with the mast height sensor to signal the presence of a lift overload with the lift mast extended.

13 Claims, 4 Drawing Figures

Fig. 1
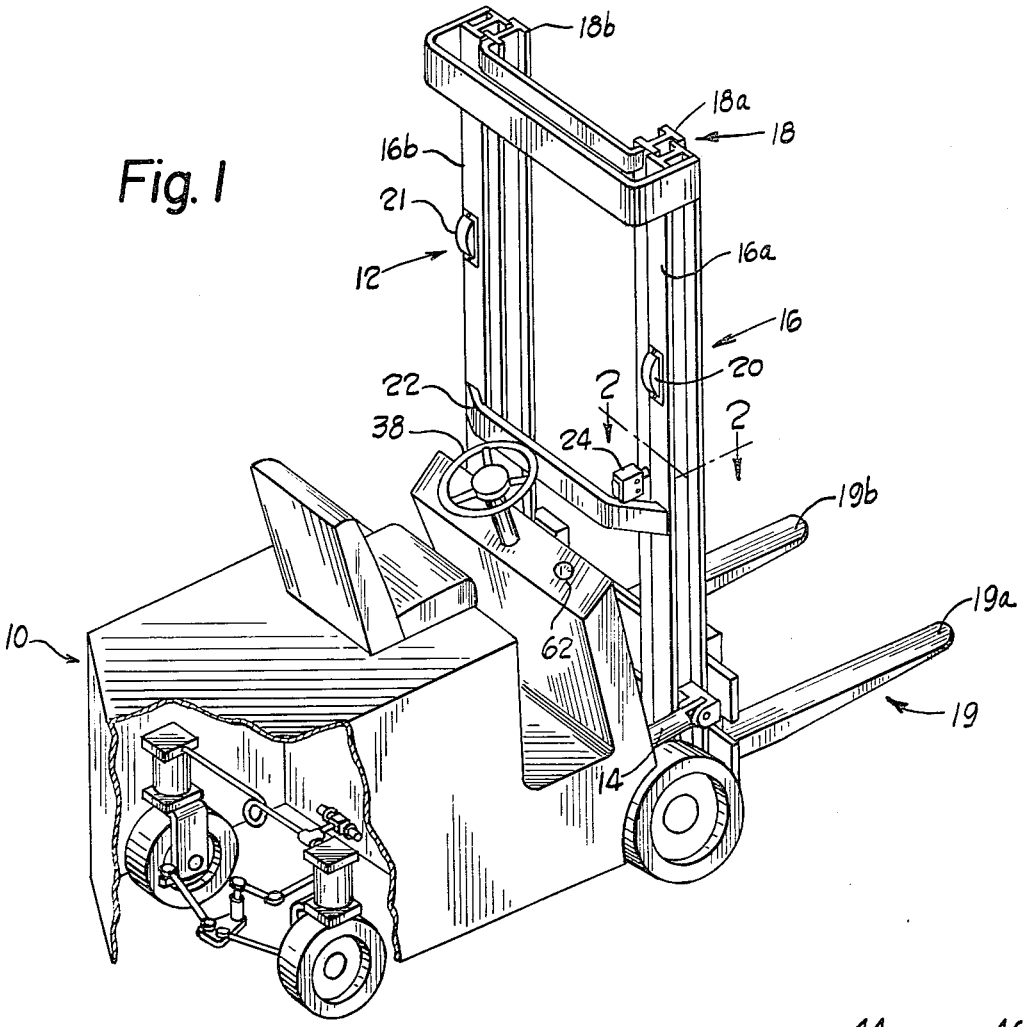
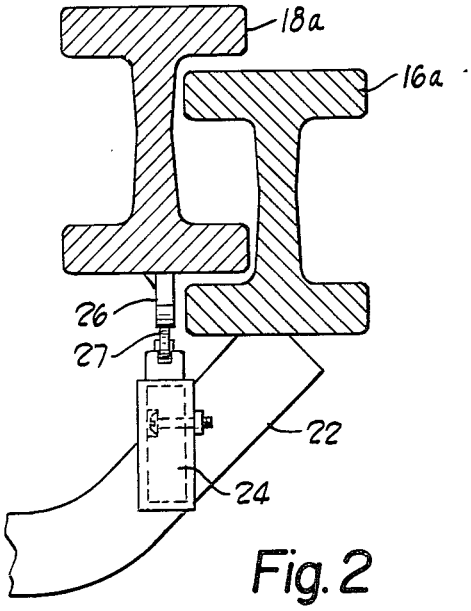
Fig. 2
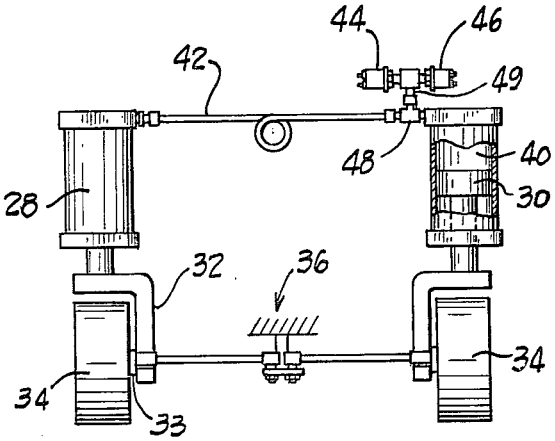
Fig. 3

OVERLOAD WARNING SYSTEM

BACKGROUND OF THE INVENTION

This invention relates generally to industrial lift trucks and in particular to an overload warning system which signals the operator when an excessive fork load has been encountered. Additionally, this invention relates to an improvement in the vehicle disclosed and claimed in U.S. Pat. No. 3,207,249 issued Sept. 21, 1965, under the title Power Plant Support Means for Industrial Vehicle.

The load capacity of an industrial lift truck is determined by several factors. In the type of lift truck on which the lifting apparatus is mounted forward of the front wheels, the load capacity will be primarily determined by the weight of the vehicle to the rear of the front wheels and the location of its center of gravity. In operation, the load being elevated creates a moment force about the axis of the front wheels tending to tilt the vehicle forward. The weight on the rear of the vehicle acting as a "counterweight" creates an opposing downward moment tending to right the vehicle. As long as the moment force created by the "counterweight" exceeds the moment force established by the lift load, the vehicle will remain stable. Essentially, the front wheels act as a fulcrum balancing the "counterweight" and load forces.

Even though a very significant portion of a vehicle's weight is constant, the weight of the rear of the vehicle and the location of its center of gravity will vary. Examples of factors which cause the weight to vary are: the weight of the operator, the weight of non-standard equipment and accessories, and the weight of fuel being carried. During the course of operation, the load capacity of the vehicle will fluctuate as these and other parameters change.

The magnitude of the load created moment force is determined by the weight of the load and the distance of its center of gravity from the front wheels. Only the adverse combination of both of these parameters can define and precipitate an unstable condition; the value of only one parameter cannot. It should be readily apparent that a given "stable" load condition may become an unstable condition if the center of gravity of the load is far enough from the front wheels to establish a moment force greater than that created by the rear "counterweight". Further compounding the problem is the fact that as the lift mast is tilted forward the effective moment arm between the front wheel axis and the load center of gravity increases.

Several prior proposals have been suggested which, directly or indirectly, sense a load being carried on the lift mast. One proposal would use pressure sensitive transducers in the hydraulic lifting circuit. The pressure in the mast lift cylinder is related to the weight of the load, but the pressure generated by given load will vary depending on the tilt angle of the mast. As it is tilted forward, the force generated by the load will be distributed between the tilt and the lift cylinders. It would seem that for a given load weight, this proposed system would see less load as the mast tilt angle increased even though increasing the tilt angle in fact increases the potential for an unstable condition. A further disadvantage of this system is its insensitivity to the load center of gravity. As was discussed earlier, it is the moment force established by the load that precipitates an unstable condition and not the load weight alone. This proposed system would not recognize a load capable of generating an unstable condition due to its center of gravity location.

Another proposal would utilize a strain guage mounted to the tilt cylinder hardware, specifically the clevis pin. Generally, the force applied to the tilt cylinder during operation will be related to the moment force applied by the load. The forces on the cylinder are not however, related to the stabilizing moment force established by the weight of the rear of the vehicle. This proposal is insensitive to fluctuations in the rear "counterweight" forces. Additionally, sophisticated and costly processing equipment is necessary to deal with the strain guage signal.

A third proposal relies on the fact that the load being carried tends to raise the rear portion of the vehicle, unloading the rear suspension. The rear suspension loading is related to the moment force applied by the lift mast carried load, and to the moment force applied by the weight on the rear of the vehicle. In fact, the rear suspension loading is directly related to the net difference between the two opposing moment forces. The unloading of the suspension is physically manifested as an increased distance between the unsprung and sprung portions of the rear of the vehicle.

Prior proposals would utilize movement due to unloading the rear suspension to actuate switches placed on various support members and at various locations. One such proposed system suggests the placement of a switch above the rear spring support pivot of a leaf spring type suspension in an industrial lift truck. A housing surrounding the spring support allows it to move vertically a limited amount, in response to the load being carried on the front of the vehicle. A switch is mounted above the support and is actuated by an associated plunger upon a predetermined movement in this rear spring support. Since in typical leaf spring suspensions, the spring mounting points are rigidly secured to the vehicle frame, the mounting apparatus required to accomplish this proposed system represents an added complexity in vehicle suspensions.

Other such systems suggest the placement of actuating members intermediate the ends of the leaf spring such that a predetermined movement in the leaf spring actuates a switch mounted above the actuating member. This system, among other shortcomings, is affected adversely by spring fatigue.

Because all of the systems would employ only suspension activated switches, these systems would not correlate the vehicle mast height with the rear suspension movement and therefore these proposals would be sensitive to only one unstable condition. As was discussed the vehicle load capacity decreases with the distance to which the load is raised and therefore correlation between mast height and suspension loading is an important consideration.

Generally, these prior proposed suspension activated overload systems would employ only one switch mounted to one side of the vehicle. The sensing of suspension load on only one side of the vehicle, may result in erroneous load indications when an eccentric load is being maneuvered. Depending on suspension configuration systems employing single suspension activated switches, may not reliably respond to an overload in which the center of gravity is near the vehicle side to which a sensing switch is mounted. Thus, the presence of a potential unstable condition would not be signalled to the operator.

Mounting and adjustment of these proposed suspension actuated switches would be critical and being mechanical in nature would tend to require periodic readjustment. Additionally, the mechanical suspension movements on which these systems would rely are subject to frictional and hysteresis effects.

SUMMARY OF THE INVENTION

The present invention overcomes the foregoing limitations with a simple and reliable system. It further presents an overload warning system having a flexibility and preciseness heretofore unknown in the art. In its preferred embodiment, a fluid supported rear suspension is used in which each rear wheel is supported by a fluid filled cylinder. A conduit provides fluid communication between these cylinders and is able to transfer fluid from one cylinder to the other to level the vehicle as it travels over uneven terrain.

Because the weight of the rear of the vehicle is supported by a fluid contained in the communicating cylinders, the fluid pressure in the conduit will reflect the moment force applied by the lift load. As the load increases, the rear portion of the vehicle will tend to rise unloading the rear suspension and resulting in a pressure drop in this conduit.

When the lifting mast is lowered, a larger load can be safely transported than can be transported with the lift mast elevated. This is due primarily to the tilt geometry of the lift mast. At low elevation heights, tilting the lift mast forward will not result in a substantial increase in the distance between the front wheels and the load center of gravity. As the lift is elevated, the increase in this distance or load moment arm for a given tilt angle is amplified. At extreme elevation heights, the load condition change can be so severe that vehicle instability can result.

This invention, unlike the prior art systems, anticipates and solves this problem by providing multiple pressure responsive switches in fluid communication with the conduit. Each switch is selected and adjusted to be actuated by a different conduit pressure corresponding to a different lift overload condition. Thus, one switch is responsive to a conduit pressure corresponding to the maximum load that can be transported with the lift mast lowered and the second switch is responsive to the conduit pressure corresponding to the maximum load that can be transported with the lift mast elevated.

The vehicle is further provided with a height sensor on its lift mast in the form of a switch. This switch is actuated whenever the lift mast is elevated above a predetermined height. The lift mast sensor and the second pressure switch co-operate to indicate an overload condition with the lift mast elevated above a predetermined height. In the preferred embodiment, actuation of the first pressure responsive switch or the concurrent actuation of the second pressure switch and the mast switch, cause an operator overload signal to be energized.

The lift load being sensed by both pressure responsive switches is in fact the moment force created by the combination of the weight of the load and the distance of its center of gravity from the front wheels. Because the pressure responsive switches are mounted in the common fluid conduit connecting the fluid supports, the system monitors the total suspension load. The efficacy of this system does not depend on the load distribution and uniformly distributed overloads as well as eccentric overloads are equally recognized. Being a fluid system, it is not plagued by the error producing frictional and hysteresis effects of mechanical systems. This system also accurately and precisely indicates an unstable vehicle load condition regardless of the shape or physical size of the load. The accuracy of the system is not affected by the mast tilt angle.

It is the general object of this invention to provide a reliable but economical overload warning system for an industrial lift truck.

It is a further object of this invention to provide an overload indicator that is responsive to degrees of overload. Specifically, an overload with the lift apparatus substantially retracted and an overload condition with the lift apparatus elevated above a predetermined height.

Further objects of this invention and a fuller understanding will become obvious in reading the following apparatus description.

BRIEF DESCRIPTION OF THE DRAWINGS

FIG. 1 is a perspective view of an industrial lift truck incorporating this invention.

FIG. 2 is a sectional view of the lift mast taken along the lines 3—3 of FIG. 1.

FIG. 3 is a view of the rear suspension of the vehicle incorporating a portion of this invention.

DESCRIPTION OF THE PREFERRED EMBODIMENT

Figure 4:
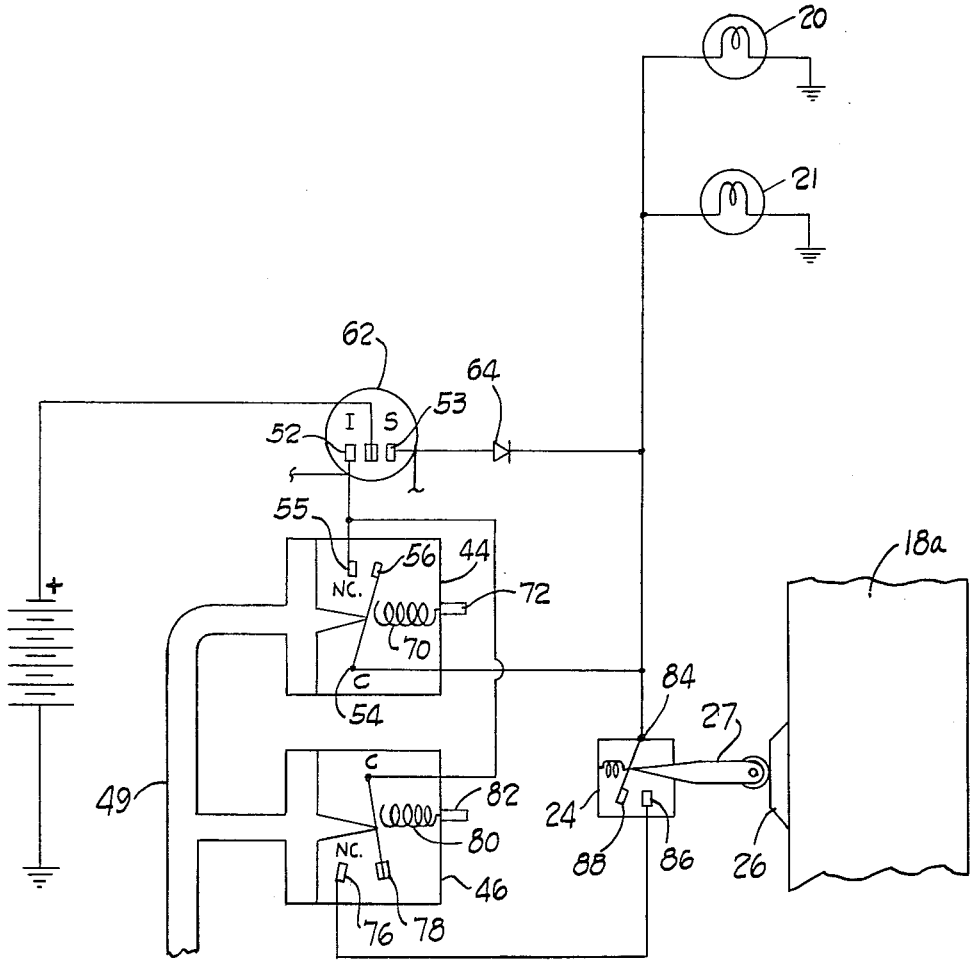
FIG. 4 is a pictorial circuit diagram of the overload warning system.

Referring to FIG. 1, there is shown an industrial lift truck 10 with a rear portion broken away to show the rear suspension. A lift mast 12 is pivotally mounted to the front of the truck, its angular position being governed by tilt cylinder 14. The lift mast 12 includes a stationary upright 16 and at least one extendable upright 18. The stationary upright 16 and the extendable upright 18 include a pair of vertical members **16*a*, 16*b* and a pair of vertical members 18*a*, 18*b***, respectively. The extendable portions of the lift mast are raised or lowered by a hydraulic actuator (not shown) known in the art.

The lift truck 10 is powered by a combustion engine (not shown). A battery (not shown) supplies electrical power to start the engine and further to supply current to the vehicle electrical system when the engine driven generator is not operating. The combustion engine not only provides motive power but also drives the pump which provides pressurized fluid to the hydraulic lift.

Overload warning indicators 20, 21 are mounted on the rear flange surface of the stationary vertical members, **16*a*, 16*b* respectively. A cross member 22 maintains these vertical members in rigid spaced relation. A mast height sensor switch 24 is mounted to this cross member and is actuated by a cam surface 26 mounted to the extensible upright member 18*a* (shown in FIG. 2 and FIG. 4**).

The cam surface 26 is located in a position such that when extendable upright 18 is not extended, it contacts and depresses the actuating plunger 27 of the switch 24. As the extendable upright 18 ascends, the plunger of switch 24 falls off the cam surface, signalling the overload system that the lift mast is extending. In the preferred embodiment, the cam surface 26 is mounted to the vertical member 18*a* of the innermost extendable upright 18.

The lift mast 12, includes an elevatable load carriage 19 having forks 19*a* and 19*b*. The height that the load carriage 19 elevate before the extensible mast 18 begins to raise will depend on the "free lift height" of the lift mast. The "free lift height" is determined by lift mast construction and the type of hydraulic actuator utilized. In a lift mast in which free lift height is maximized, the load carriage is elevated to the top of the innermost extendable upright before the upright begins to ascend whereas in a lift mast in which the free lift type is minimized, the innermost extensible upright and load carriage will ascend more or less concurrently.

The length of the cam surface 26 is selected and configured to accomodate the "free lift height" of a particular vehicle. In a lift mast in which the free lift height is maximized, the cam surface 26 is sized and located such that the upward movement of the extensible upright immediately causes the switch plunger 27 to be released. In a lift mast in which the free height is minimized, the cam surface 26 is lengthened to delay the actuation or release of the plunger 27 of the switch 24. Thus, the extensible upright must extend a preset distance before switch plunger 27 is released. In both cases, the switch 24 closes when the switch plunger 27 falls off the cam surface 26 and opens when the cam surface 26 re-engages and depresses the switch plunger 27 upon retraction of the inner mast member.

The rear suspension of the vehicle is shown in FIG. 2. The suspension includes fluid supports 28 which slidably and rotatably receive piston assembly 30. Extending downwardly from each piston is a wheel support member 32 which includes axles 33 on which the rear wheels 34 are rotatably mounted. A steering wheel 38 is mounted for manipulation by the vehicle operator and is operatively connected to a steering mechanism shown generally as 36 which controls the steering motion of the rear wheels.

The fluid supports 28 each contain a fluid chamber 40 which is filled with a fluid. A conduit 42 establishes communication between the individual fluid supports and allows fluid to be transferred between the supports in response to unbalanced loading on the rear of the vehicle. Pressure responsive switches 44 and 46 are mounted in fluid communication with the conduit 42 by means of a tee connection 48 and a conduit 49.

The pressure responsive switches 44 and 46 are selected and adjusted to be sensitive to different pressures in the conduit 42. In the preferred embodiment, these switches are of the normally closed variety. In other words, the absence of a minimum pressure causes the switch to become electrically conductive. As was discussed above, the weight of the load being transported and/or elevated by the load carriage is reflected in the rear suspension loading. As the load on the load carriage increases, the loading of the rear suspension will decrease. In the fluid suspension of the present invention, a decrease in the rear suspension loading will be manifested by a decrease in fluid pressure in the conduit 42. Thus, by the proper selection and adjustment of the switches 44 and 46, two different overload conditions can be sensed.

FIG. 4 shows both the mechanical and the electrical interconnections of the various components of the invention. The pressure responsive switch 44 has a common terminal 54, a "normally closed" contact 55 and a switching contact 56. A spring 70 biases the switching contact 56 towards engagement with the "normally closed" contact 55. Fluid pressure in the conduit 49 acts in opposition to the spring 70 and urges the switching contact 56 away from the contact 55. The fluid pressure value in the conduit 49 which will effect the disengagement of the switching contact 56 from the contact 55 is determined by a spring force adjustment 72.

Pressure responsive switch 46 is similar to switch 44. It has a common terminal 74, a "normally closed" contact 76 and a switching contact 78. A spring 80 urges the switching contact 78 into engagement with the contact 76. This urging force is set by an adjustment 82.

The mast height sensor switch 24 has a common terminal 84, a "normally closed" contact 86, and a switching contact 88. Whenever the plunger 27 is in contact with the cam surface 26, the switching contact 84 is disengaged from the contact 86. The switch 24 becomes electrically conductive whenever the plunger 27 is not in contact with the cam surface 26.

The warning indicators 20, 21 are electrically connected to the terminal 54 of the pressure switch 44 and the terminal 84 of the mast height sensor switch 24. The overload warning system receives supply current from an ignition terminal 52 of a key switch 62. Thus, the overload system is supplied with power whenever the vehicle is in an operating mode.

Supply current from the key switch 62 is conveyed from the ignition terminal 52 to the contact 55 of the switch 44 and the contact 74 of the switch 46. It should be apparent that whenever pressure switch 44 is electrically conductive, current will flow from the ignition terminal of the key switch to the prssure switch 44, then to the warning indicators 20, 21. The pressure switch 46 is interposed in the circuit between the ignition terminal of the key switch 62 and the mast height sensor switch 24. If both the pressure switch 46 and the mast switch are closed (electrically conductive), current will flow to the warning indicators 20, 21.

A warning indicator bulb check feature is incorporated in the circuit. A "S" terminal 53 or "starter" terminal of the key switch 62 is connected through a diode 64 to the circuit as shown in FIG. 4. Thus whenever the starter of the vehicle is energized, current will flow from the start (S) terminal 53 of the key switch 62 through the diode 64, then to the warning lamps 20, 21. A diode is placed between the start terminal of key switch 62 and the bulb circuit in order to prevent the energization of the starter whenever the warning indicators 20, 21 are activated by the warning system. If the diode 64 was not in the circuit, current would not only flow to the warning indicators 20, 21 during an overload condition, but it would also flow to the starter circuit and energize the starter.

The operation of the system can best be explained by reference to FIG. 4. As was indicated the overload warning system of this invention is sensitive to one overload condition with the lift mast retracted and a second overload condition with the lift mast extended. In order to accomplish this two-step sensitivity, pressure sensitive switches 44 and 46 are selected and adjusted to be operated at two different preset conduit pressures. The pressure switch 44 is selected to be sensitive to a conduit pressure which corresponds to an overload condition with the lift mast retracted. If an overload of this nature is encountered, the pressure in conduit 42 and hence 49 will decrease allowing pressure switch 44 to become deenergized. The deenergization of switch 44 results in it becoming electrically conductive. Current will then flow from the ignition terminal 52 of the key switch 62 through the switch 44 and to the warning indicators 20, 21.

The switch 46 is selected and adjusted to be activated by a pressure in conduit 42 corresponding to an overload with the lift mast extended. If a load is engaged by the lift mast, which if elevated would result in an unstable situation, the attendant pressure decrease in conduit 42 will deenergize switch 46 causing it to become electrically conductive. This alone will not cause the warning lights to be activated however. Current to warning indicators 20, 21 is still interrupted by mast height sensor switch 24. As long as the lift mast remains retracted, the warning system will remain inactive. If the lift mast extends, plunger 27 of switch 24 will fall off the cam 26 causing the circuit to be complete. Current will then be allowed to flow from the ignition terminal 52 through the switch 46, through switch 24 and to the warning indicators 20, 21.

The overload system has been described with reference to a combustion engine driven industrial lift truck. It should be obvious to one skilled in the art that a similar system can be incorporated on lift trucks employing other means for motive power such as electrical propulsion. Because the vehicle probably would not have an ignition terminal or a start terminal on the key switch, another source of supply current would have to be provided. This source could be a battery supply controlled through the vehicle on-off switch. A manual or separate bulb check feature could also be furnished.

It should now be apparent, that a novel warning system is presented by this description. This system being actuated by a fluid pressure is very precise and requires a minimum amount of maintenance. Furthermore, it is sensitive to the moment force created by the load on the lift mast and it can distinguish between to different overload situations.

Although the overload warning system of this invention has been described with a certain degree of particularity, various changes and modifications can be made to it by those skilled in the art without departing from the spirit and scope of the invention as described and hereinafter claimed.

What is claimed is:

1. In a vehicle adapted for the transporting and the elevating of loads, the vehicle having a load support and a pair of wheels spaced from the load support, an overload indicator comprising:

(a) a pair of fluid vehicle supports connected to and forming a part of said vehicle;

(b) each one of the pair of supports including a movable piston means;

(c) said piston means including a downwardly extending member defining a wheel support for connecting to said wheels;

(d) a conduit means for interconnecting said fluid supports to allow transfer of fluid to level the vehicle when the loads on said wheels are unbalanced;

(e) a first and second pressure responsive means in fluid communication with said conduit;

(f) the first pressure responsive means actuatable by a preset pressure in the fluid conduit corresponding to an overload condition with the load lifting apparatus substantially retracted;

(g) the second pressure responsive means actuatable by a preset pressure in the conduit higher than the pressure that actuates the first pressure responsive means, corresponding to an overload condition with the lifting apparatus extended beyond a preset height;

(h) a sensing means actuated at a preset elevation of the lifting apparatus;

(i) said second pressure responsive means and sensing means being electrically connected such that upon actuation of both, an overload condition with the lifting apparatus elevated above a predetermined height is indicated; and (j) upon actuation of the first pressure responsive means, an overload condition with the lifting apparatus substantially retracted is indicated.

2. The indicator of claim 1 wherein the first and second pressure responsive means comprises first and second fluid pressure actuated electrical switches.

3. In a fork lift truck having rear wheels supported by fluid cylinders in fluid communication with each other through a fluid conduit, an overload indicator comprising:

(a) a first and second pressure responsive means in fluid communication with said conduit;

(b) the first pressure responsive means actuatable by a preset pressure in the fluid conduit corresponding to an overload condition with the load lifting apparatus substantially retracted;

(c) the second pressure responsive means actuatable by a preset pressure in the conduit higher than the pressure that actuates the first pressure responsive means, corresponding to an overload condition with the lifting apparatus extended beyond a preset height;

(d) a sensing means actuated at a preset elevation of the lifting apparatus;

(e) said second pressure responsive means and sensing means being electrically connected such that upon actuation of both, an overload condition with the lifting apparatus elevated above a predetermined height is indicated; and (f) upon actuation of the first pressure responsive means, an overload condition with the lifting apparatus substantially retracted is indicated.

4. In a fork lift truck having rear wheels supported by fluid cylinders in fluid communication with each other through a fluid conduit, an improvement comprising an overload indicator including:

(a) a first and second pressure responsive means in fluid communication with said conduit;

(b) the first pressure responsive means actuatable by a preset pressure in the fluid conduit corresponding to an overload condition with the load lifting apparatus substantially retracted;

(c) the second pressure responsive means actuatable by a preset pressure in the conduit higher than the pressure that actuates the first pressure responsive means, corresponding to an overload condition with the lifting apparatus extended beyond a preset height;

(d) a sensing means actuated at a preset elevation of the lifting apparatus;

(e) said second pressure responsive means and sensing means being electrically connected such that upon actuation of both, an overload condition is indicated; and (f) upon actuation of the first pressure responsive means, an overload condition is indicated.

5. A vehicle adapted for the transporting and elevating of loads comprising:

(a) a main frame;

(b) a prime mover supported by the main frame;
(c) a ground engaging means;
(d) a load lifting apparatus suitable mounted on the front portion of the vehicle;
(e) a pair of steerable rear wheels;
(f) a pair of fluid supports disposed on the rear portion of the vehicle;
(g) each support including a movable piston means;
(h) each piston means including a downwardly extending wheel support carrying a horizontally disposed axle on which an associated rear wheel is rotatably mounted;
(i) a conduit means for interconnecting the fluid supports to allow transfer of fluid to level the rear of said vehicle when the loads on the rear wheels are unbalanced;
(j) first and second pressure responsive means in fluid communication with said conduit;
(k) the first pressure responsive means being actuatable by a decrease in pressure below a preset value in the fluid conduit, corresponding to an overload condition with the load lifting apparatus substantially retracted;
(l) the second pressure responsive means being actuatable by a decrease in pressure below a second higher preset value corresponding to an overload condition with the lifting apparatus extended beyond a preset height;
(m) a sensing means actuated at a preset elevation of the lifting apparatus; and
(n) upon the co-actuation of both the second pressure responsive means and sensing means an overload condition with the lifting apparatus elevated above a predetermined height is present.

6. The system of claim 5 wherein upon actuation of the first pressure responsive means or upon the co-actuation of both the second responsive means and the sensing means, the presence of the overload condition is signalled.

7. The vehicle of claim 6 including additional pressure responsive means actuatable by decreases in the conduit means pressure below various preset values and additional sensing means each actuatable at different preset elevation heights, said pressure responsive and sensing means co-operating to signal overload conditions at various predetermined lift elevation heights.

8. The system of claim 5 wherein upon actuation of the first pressure responsive means or upon the co-actuation of both the second responsive means and the sensing means, the operation of the vehicle is suitably inhibited.

9. For a vehicle adapted for the transporting and the elevating of loads having a load lifting apparatus operatively mounted on its front portion, a rear suspension system comprising:
(a) a pair of fluid supports disposed on the rear portion of the vehicle;
(b) each support including a moveable piston means;
(c) each piston means including a downwardly extending wheel support carrying a horizontally disposed axle;
(d) an associated wheel rotatably mounted on each of the axles;
(e) a conduit means for interconnecting the fluid supports to allow transfer of fluid to level the rear of said vehicle when the loads on the rear wheels are unbalanced;
(f) first and second pressure responsive means in fluid communication with said conduit;
(g) the first pressure responsive means be actuatable by a decrease in pressure below a preset value in the fluid conduit, corresponding to an overload condition with the load lifting apparatus substantially retracted;
(h) the second pressure responsive means being actuatable by a decrease in pressure below a second higher preset value corresponding to an overload condition with the lifting apparatus extended beyond a preset height;
(i) a sensing means actuated at a preset elevation of the lifting apparatus;
(j) upon the co-actuation of both the second pressure responsive means and sensing means an overload condition with the lifting apparatus elevated above a predetermined height is present; and
(k) upon actuation of the first pressure responsive means, an overload condition with the lifting apparatus substantially retracted is indicated.

10. In a vehicle adapted for the transporting and the elevating of loads, the vehicle having a load support and a pair of wheels spaced from the load support, an overload indicator comprising:
(a) a pair of fluid vehicle supports connected to and forming a part of said vehicle;
(b) each one of the pair of supports including a movable piston means;
(c) said piston means including a member defining a wheel support for connecting thereto, said wheels;
(d) a conduit means for interconnecting said fluid supports to allow transfer of fluid to level the vehicle when the loads on said wheels are unbalanced;
(e) a pressure responsive means in fluid communication with said conduit and actuatable by a preset pressure in the conduit, corresponding to an overload condition with the lifting apparatus extended beyond a preset height;
(f) a sensing means actuated at a preset elevation of the lifting apparatus; and
(g) upon the co-actuation of both the sensing means and the pressure responsive means, an overload condition is indicated.

11. In a vehicle adapted for the transporting and the elevating of loads, the vehicle having a load support and a pair of wheels spaced from the load support, an overload indicator comprising:
(a) a pair of fluid vehicle supports connected to and forming a part of a wheel suspension for said vehicle;
(b) each one of the pair of supports including a movable piston means;
(c) said piston means including a member defining a wheel support for connecting thereto, said wheels;
(d) a conduit means for interconnecting said fluid supports to allow transfer of fluid to level the vehicle when the loads on said wheels are unbalanced;
(e) a pressure responsive means in fluid communication with said conduit and actuatable by a preset pressure in the fluid conduit corresponding to an overload condition on the load lifting apparatus; and
(f) upon co-actuation of the pressure responsive means and a means to sense a preset elevation of the lifting apparatus, the overload condition on the lifting apparatus is signalled.

12. In an industrial lift vehicle adapted for the transporting and the elevating of loads, the vehicle having a lift apparatus, a pair of wheels spaced from the lift apparatus and movably supported by an associated vehicle suspension, an overload indicator comprising:

(a) first and second load responsive means suitably mounted for actuation by load induced movements in the vehicle suspension;

(b) said first load responsive means actuatable by a movement in the vehicle suspension corresponding to an overload condition with the load lifting apparatus substantially retracted;

(c) said second load responsive means being actuatable by a movement in the vehicle suspension corresponding to an overload condition with the lifting apparatus extended beyond a preset height;

(d) a sensing means actuated at a preset elevation of the lifting apparatus; and (e) upon the actuation of the first load responsive means or upon the co-actuation of both the second load responsive means and the sensing means, the presence of the overload condition is signalled.

13. The vehicle of claim 12 including additional load responsive means actuatable by predetermined movements in the vehicle suspension and additional sensing means each actuatable at different preset elevation heights, said load responsive and sensing means cooperating to signal overload conditions at various predetermined lift elevation heights.

* * * * *